US008870367B2

(12) United States Patent
Delmerico

(10) Patent No.: US 8,870,367 B2
(45) Date of Patent: Oct. 28, 2014

(54) PRINTED IMAGE FOR VISUALLY-IMPAIRED PERSON

(75) Inventor: Richard Delmerico, Henrietta, NY (US)

(73) Assignee: Eastman Kodak Company, Rochester, NY (US)

( * ) Notice: Subject to any disclaimer, the term of this patent is extended or adjusted under 35 U.S.C. 154(b) by 280 days.

(21) Appl. No.: 13/461,875

(22) Filed: May 2, 2012

(65) Prior Publication Data

US 2013/0293657 A1 Nov. 7, 2013

(51) Int. Cl.
*B41J 2/01* (2006.01)

(52) U.S. Cl.
USPC ..... 347/107

(58) Field of Classification Search
CPC ..... B41J 2202/09; B41J 2/01; B41J 2/04508; G02B 5/201; G02F 1/133516
USPC ..... 347/107, 171; 101/483
See application file for complete search history.

(56) References Cited

U.S. PATENT DOCUMENTS 4,073,070 A 2/1978 Boston
4,404,764 A * 9/1983 Wills et al. ..... 40/124.11
4,972,501 A 11/1990 Horyu
5,125,996 A 6/1992 Campbell et al.
5,627,578 A * 5/1997 Weintraub ..... 347/101
5,846,622 A * 12/1998 Imaeda ..... 428/40.1
6,755,350 B2 6/2004 Rochford et al.
7,014,910 B2 3/2006 Rochford et al.
7,290,951 B2 11/2007 Tanaka et al.
8,064,788 B2 11/2011 Zaretsky et al.
2002/0003469 A1 1/2002 Gupta
2002/0009318 A1* 1/2002 Maie ..... 400/109.1
2004/0032601 A1* 2/2004 Ishii et al. ..... 358/1.9
2006/0133870 A1 6/2006 Ng et al.
2008/0159786 A1 7/2008 Tombs et al.
2010/0180781 A1* 7/2010 Foppapedretti ..... 101/28
2011/0200360 A1 8/2011 Tyagi et al.
2011/0200932 A1 8/2011 Tyagi et al.
2011/0200933 A1 8/2011 Tyagi et al.

* cited by examiner

*Primary Examiner* — Manish S Shah
*Assistant Examiner* — Yaovi Ameh
(74) *Attorney, Agent, or Firm* — Kevin E. Spalding

(57) ABSTRACT

A method for printing an image to convey information to both a sighted person and a visually-impaired person. An image including image content is printed on a receiver medium using one or more visible colorants, the printed image being viewable by the sighted person. A vocabulary of different tactile patterns is defined, each tactile pattern having a defined meaning. Tactile patterns are selected from the predefined vocabulary and are provided on the surface of the printed image such that when a visually-impaired person touches the tactile pattern at a particular location, the tactile pattern conveys information about the corresponding image content at the particular location to the visually-impaired person.

24 Claims, 7 Drawing Sheets

PRINTED IMAGE FOR VISUALLY-IMPAIRED PERSON

FIELD OF THE INVENTION

This invention pertains to the field of printing and more particularly to a method of printing an image that conveys information to both a sighted person and a visually-impaired person.

BACKGROUND OF THE INVENTION

Since the invention of the printing press, printed images have become a common way to communicate information. Printed images can include text, as well as other types of image content such as photographic images and graphical image elements (e.g., pie charts, logos and computer generated artwork).

While printed images are effective to communicate information to sighted persons, there is a significant minority of the human population who suffer from visual impairment, including blindness. Printed images have little or no value for this population segment.

A variety of methods have been developed for communicating information to visually impaired individuals. The Braille system is a method that is widely used by people who are visually-impaired to enable them to read and write. Braille was devised in 1825 by Louis Braille, and involves forming tactile characters using patterns of raised dots. Each Braille character, or cell, is made up of six dot positions, arranged in a rectangle containing two columns of three dots each. A dot may be raised at any of the six positions to form sixty-four possible arrangements (including the arrangement in which no dots are raised). Conventionally, Braille characters are "printed" using devices that emboss the desired dot patterns into a receiver such as paper.

In recent years, various systems have been developed for forming tactile patterns, including Braille characters, using electrographic printing technology. For example, commonly-assigned, U.S. Patent Application Publication 2008/0159786 to Tombs et al., entitled "Selective printing of raised information by electrography," and commonly-assigned U.S. Pat. No. 8,064,788 to Zaretsky et al., entitled "Selective printing of raised information using electrography," describe methods for printing raised information with a tactile feel using toner particles having a substantially larger size than standard size marking particles that are used to form printed images.

Commonly-assigned U.S. Patent Application Publication 2011/0200360 to Tyagi et al., entitled "System to print raised printing using small toner particles," and commonly-assigned U.S. Patent Application Publication 2011/0200933 to Tyagi et al., entitled "Raised printing using small toner particles," disclose methods to print raised letters using small toner particles that involve using multiple layers of toner.

Commonly-assigned U.S. Patent Application Publication 2011/0200932 to Tyagi et al., entitled "Raised letter printing using large yellow toner particles," discloses a method to produce prints with raised letters by forming multi-color toner images and fusing the print one or more times.

A variety of other methods are also known in the art for forming tactile image content. For example, commonly-assigned U.S. Pat. No. 5,125,996 to Campbell et al., entitled "Three dimensional imaging paper," discloses an imaging paper having dispersed throughout hollow expanding synthetic thermoplastic polymeric microspheres. Tactile information can be provided by using a scanning laser beam (or some other thermal source) to cause discrete areas of the paper to expand.

Zychem Ltd of Middlewich, Cheshire, UK have developed a product known as Zytex2 Swell Paper onto which images can be printed and made into tactile diagrams. This product can be used to form, Braille or other forms of tactile patterns. An image can be printed onto the paper, and when the paper is heated using one of our Zyfuse heating machines, the black parts of the image swell up to become tactile. This approach has the limitation that the tactile features are constrained to have a direct correspondence to the black image regions.

U.S. Pat. No. 4,972,501 to Horyu, entitled "Image processing apparatus," discloses an apparatus to enable a blind person to read characters written on a paper. The apparatus includes a photo-sensor which is used to scan the printed text. The scanned image pattern is converted to mechanical vibrations using piezoelectric elements or LEDs.

Commonly-assigned U.S. Pat. No. 6,755,350 to Rochford et al., entitled "Sensual label," and commonly-assigned U.S. Pat. No. 7,014,910 to Rochford et al., entitled "Sensual label," discloses a pressure sensitive adhesive label including at least one tactile or olfactory feature. Tactile features are provided by a textured overcoat later. The form of the tactile and olfactory features can be chosen to be related to visual content included on the label.

U.S. Pat. No. 7,290,951 to Tanaka et al., issued Sep. 7, 2006, entitled "Braille layout creation method, Braille layout creation system, program, and recording medium," discloses a Braille layout creation method where Braille characters are embossed into an object frame, in association with corresponding printed text characters.

U.S. Patent Application Publication 2002/0003469 to Gupta, entitled "Internet browser facility and method for the visually impaired," discloses a method for facilitating internet browsing for the visually impaired. The method involves using a matrix of movable tactile elements to display a representation of a file containing hypertext links. Text is translated to Braille and graphics images are converted to a dot matrix representation, with selective simplification.

There remains a need for a method to effectively convey information pertaining to photographs and graphics, to both sighted persons and visually impaired persons.

SUMMARY OF THE INVENTION

The present invention represents a method for printing an image to convey information to both a sighted person and a visually-impaired person, comprising:

printing an image including image content on a receiver medium using one or more visible colorants, the printed image being viewable by the sighted person, wherein the image content includes photographic image content, artwork image content or graphical image content;

defining a vocabulary of different tactile patterns, each tactile pattern having a defined meaning; and providing tactile patterns on the surface of the printed image, the tactile pattern provided at a particular location being selected from the predefined vocabulary such that when a visually-impaired person touches the tactile pattern at the particular location, the tactile pattern conveys information about the corresponding image content at the particular location to the visually-impaired person.

This invention has the advantage that the resulting image provides tactile information that can be sensed by a visually impaired person, while simultaneously providing an image that is viewable by a sighted person.

It has the additional advantage that the tactile information is presented in a spatially-correlated arrangement such that the tactile pattern at a particular location conveys information about the corresponding image content at that location, thereby enabling the visually-impaired person to understand the spatial relationships between the different elements of the image.

BRIEF DESCRIPTION OF THE DRAWINGS

FIG. 5 shows an example of a printed image;

Figure 1:
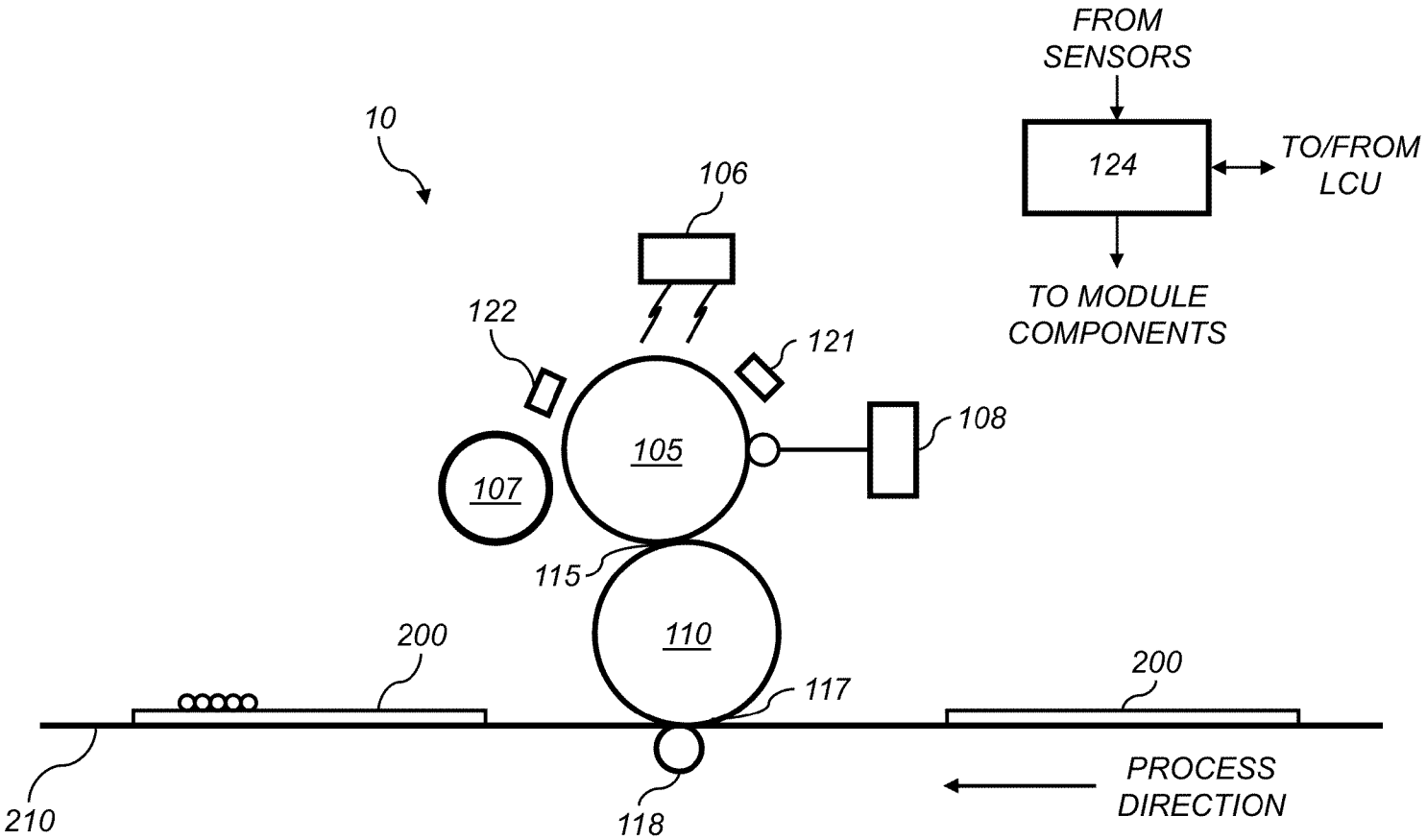
FIG. 1 is schematic diagram illustrating an exemplary electrographic printing module.

It is to be understood that the attached drawings are for purposes of illustrating the concepts of the invention and may not be to scale.

DETAILED DESCRIPTION OF THE INVENTION

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

In accordance with the present invention, printed images are produced having image content that is visible to a sighted person. Any method known in the art can be used to produce the printed images, including using printing presses (e.g., offset or gravure printing presses) or ink jet printers.

One common method for printing images on a receiver medium that can be used in accordance with the present invention is referred to as "electrography" (or "electrophotography"). In this method, an electrostatic image is formed on a dielectric member by uniformly charging the dielectric member and then discharging selected areas of the uniform charge to yield an image-wise electrostatic charge pattern. Such discharge is typically accomplished by exposing the uniformly charged dielectric member to actinic radiation provided by selectively activating particular light sources in an LED array or a laser device directed at the dielectric member. After the image-wise charge pattern is formed, the pigmented (or in some instances, non-pigmented) marking particles are given a charge, substantially opposite the charge pattern on the dielectric member and brought into the vicinity of the dielectric member so as to be attracted to the image-wise charge pattern to develop such pattern into a visible image.

Thereafter, a suitable receiver medium (e.g., cut sheet of plain bond paper) is brought into juxtaposition with the marking particle developed image-wise charge pattern on the dielectric member. A suitable electric field is applied to transfer the marking particles to the receiver medium in the image-wise pattern to form the desired print image on the receiver medium. The receiver medium is then removed from its operative association with the dielectric member and subjected to heat and/or pressure to permanently fix the marking particle print image to the receiver medium. In some embodiments, plural marking particle images of, for example, different color particles can be overlaid on one receiver medium (before fixing) to form a multi-color printed image on the receiver medium.

Figure 2:
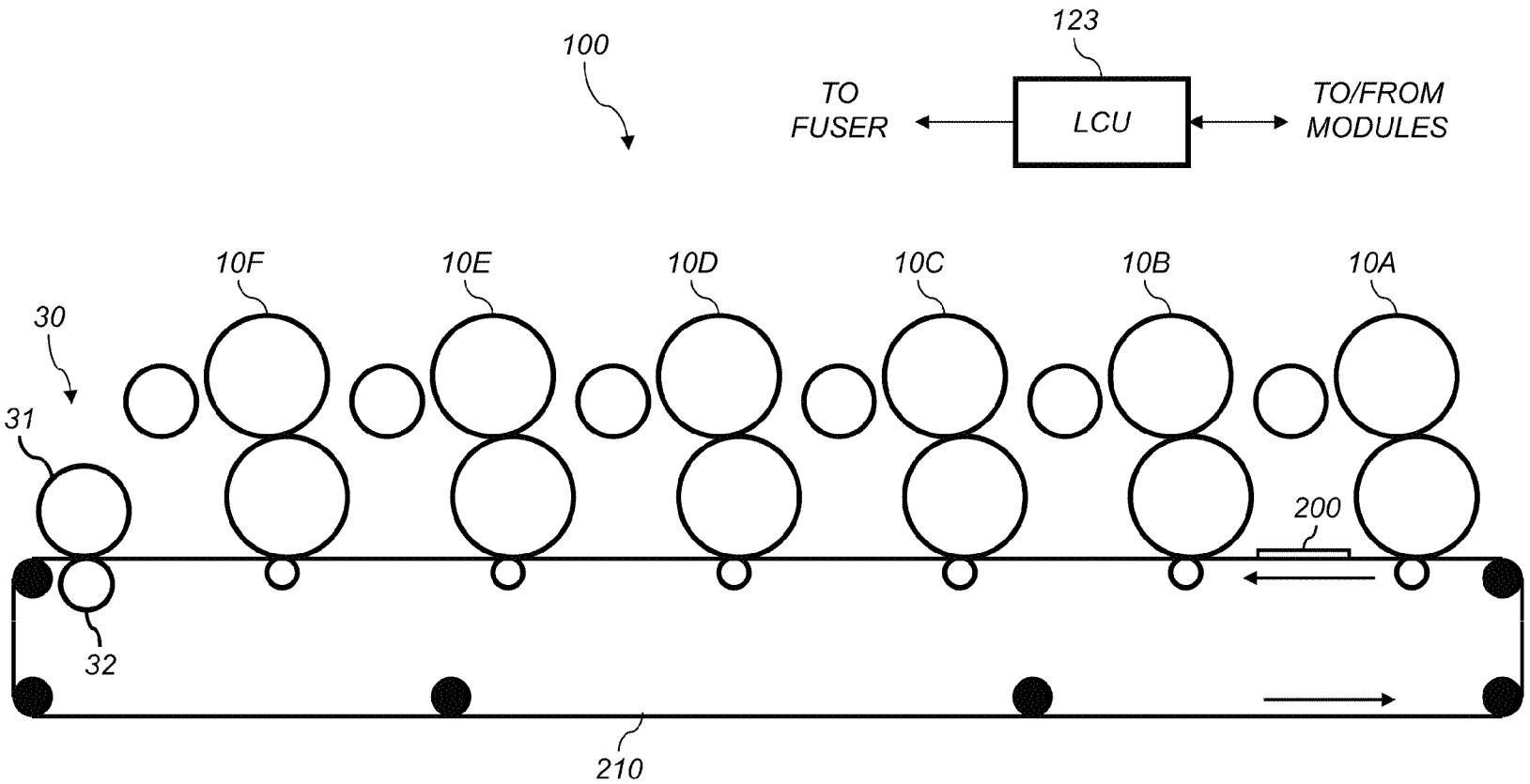
FIG. 2 is schematic diagram illustrating an electrographic printer engine that can be used to provide printed images in accordance with the present invention.

FIGS. 1 and 2 schematically illustrate an electrographic printer engine 100 according to embodiments of the current invention. Although the illustrated embodiment of the invention involves an electrographic apparatus employing six image-producing electrographic printing modules arranged therein for printing toner onto individual receiver mediums, the invention can be employed with either fewer or more than six print modules. The invention can also be practiced with other types of electrographic print modules, or with other types of printing technologies.

The electrographic printer engine 100 has a series of electrographic printing modules 10A, 10B, 10C, 10D, 10E and 10F. As discussed below, each of the electrographic printing modules 10A, 10B, 10C, 10D, 10E forms an electrostatic image, employs a developer having a carrier and toner particles to develop the electrostatic image, and transfers a developed image onto a receiver medium 200. Where the toner particles of the developer are pigmented, the toner particles are also referred to as "marking particles." The receiver medium 200 may be a sheet of paper, cardboard, plastic, or other material to which it is desired to print an image or a predefined pattern.

FIG. 1 shows an electrographic printing module 10 that is representative of each of the electrographic printing modules 10A-10F of the electrographic printer engine 100 shown in FIG. 2. The electrographic printing module 10 includes a plurality of subsystems for producing that are used in the formation of the printed image. A primary charging subsystem 108 is provided for uniformly electrostatically charging a surface of a photoconductive imaging member (shown in the form of an imaging cylinder 105). An exposure subsystem 106 is provided for image-wise modulation of the uniform electrostatic charge by exposing the photoconductive imaging member to form a latent electrostatic image. A development station subsystem 107 is provided for developing the image-wise exposed photoconductive imaging member to provide a toner image. An intermediate transfer member 110 is provided for transferring the respective toner image from the photoconductive imaging member through a first transfer nip 115 to the surface of the intermediate transfer member 110, and from the intermediate transfer member 110 through a second transfer nip 117 formed between the intermediate transfer member and a transfer backup roller 118 to the receiver medium 200.

The embodiment of an electrographic printer engine 100 shown in FIG. 2 employs six electrographic printing modules 10A, 10B, 10C, 10D, 10E and 10F each of which has the structure of the electrographic printing module 10 illustrated in FIG. 1. Each of the electrographic printing modules 10A, 10B, 10C, 10D, 10E and 10F is capable of applying a single color, transferable image to receiver medium 200. A transport belt 210 transports the receiver medium 200 for processing by the electrographic printer engine 100. As the receiver medium 200 moves sequentially through the printing nips of the electrographic printing modules 10A, 10B, 10C, 10D, 10E and 10F, the printing modules successively transfer the generated, developed images onto the receiver medium 200 in a single pass.

After moving the receiver medium through the electrographic printing modules 10A, 10B, 10C, 10D, 10E and 10F, the transport belt 210 moves the receiver medium 200 with the multi-colored image to a fusing assembly 30. The fusing assembly 30 includes a heated fusing roller 31 and an opposing pressure roller 32 that form a fusing nip to apply heat and pressure to the receiver medium 200. In some embodiments, the fusing assembly 30 also applies a fusing oil, such as silicone oil, to the fusing roller 31. Additional details of the developing and fusing process are described in U.S. Patent Application Publication 2008/0159786, which is incorporated by reference.

In the illustrated embodiment, the same transport belt 210 is used for transferring the receiver medium 200 through the electrographic printing modules 10A, 10B, 10C, 10D, 10E and 10F and for moving the receiver medium 200 through the fusing assembly 30 so that the process speed for fusing and the process speed for applying raised and print images are the same. Alternatively, separate transport mechanisms can be provided for applying images and fusing images allowing the image applying and fusing process speeds to be set independently.

The electrographic printing modules 10A, 10B, 10C, 10D, 10E and 10F are controlled using electrographic process-set points, control parameters, and algorithms appropriate for the developer for printing using the marking particles and carrier particles of the print image. The set-points, control parameters, and algorithms can be implemented in logic forming part of a logic and control unit (LCU) 123. The LCU 123 may include (or may interact with) logic and control components (LCC) 124 associated with the individual electrographic printing modules 10A, 10B, 10C, 10D, 10E. The LCCs 124 receive signals from various sensors (e.g., a meter 121 for measuring the uniform electrostatic charge and a meter 122 for measuring the post-exposure surface potential within a patch area of a patch latent image formed from time to time in a non-image area on the photoconductive imaging member) and send control signals to the primary charging subsystems 108, the exposure subsystems 106, and the development station subsystems 107.

The illustrated electrographic printer engine 100 includes six electrographic printing modules 10A, 10B, 10C, 10D, 10E and 10F, and accordingly up to six images can be formed on the receiver medium 200 in one pass. For example, electrographic printing modules 10A, 10B, 10C and 10D can be driven with image information to form black, yellow, magenta, and cyan, images, respectively. As is known in the art, a spectrum of colors can be produced by combining the primary colors cyan, magenta, yellow, and black, and subsets thereof in various combinations. The developers in the development station of electrographic printing modules 10A, 10B, 10C and 10D employ pigmented marking particles of the respective color corresponding to the color of the image to be applied by a respective electrographic printing modules 10A, 10B, 10C and 10D. The remaining two electrographic printing modules 10E and 10F, can be provided with marking particles having alternate colors to provide improved color gamut, non-pigmented colorless particles to provide a clear layer protection glossy print capability or to provide tactile features in accordance with the present invention. For example, in some embodiments the fifth electrographic printing modules 10E is provided with developer having red pigmented marking particles and the sixth electrographic printing modules 10F is provided with developer having non-pigmented particles.

Alternatively, in some embodiments the tactile features can be printed with multiple layers of a single color (e.g., with two layers of colorless toner). In this case, both electrographic printing modules 10E and 10F can be provided with the same type of toner. Additional fusing modules (not shown) can preferably be placed between electrographic printing modules 10D and 10E and between electrographic printing modules 10E and 10F. This enables multiple colorless images to be printed in register, thereby creating a final stack height sufficient to provide raised tactile features on selected areas of the receiver medium 200. In order to provide a tactile feel, it is desirable to achieve a post fusing stack height of at least 20 μm on a receiver medium. However, 40 to 50 μm and greater stack heights are often desirable for some applications, and in some cases even greater stack heights including heights of 100 μm and more are desirable.

The term particle size, as used herein, refers to developer and carrier, as particles as well as marking and non-marking particles. The mean volume weighted diameter is measured by conventional diameter measuring devices, such as a Coulter Multisizer, sold by Coulter, Inc. and the mean volume weighted diameter is the sum of the mass of each particle times the diameter of a spherical particle of equal mass and density, divided by total particle mass.

Figure 3A:
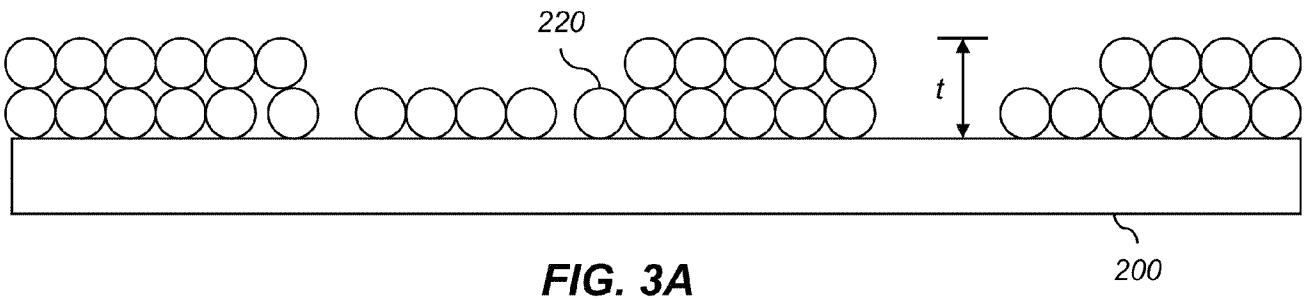
FIG. 3A illustrates a visible printed image formed on a receiver medium.
Figure 3B:
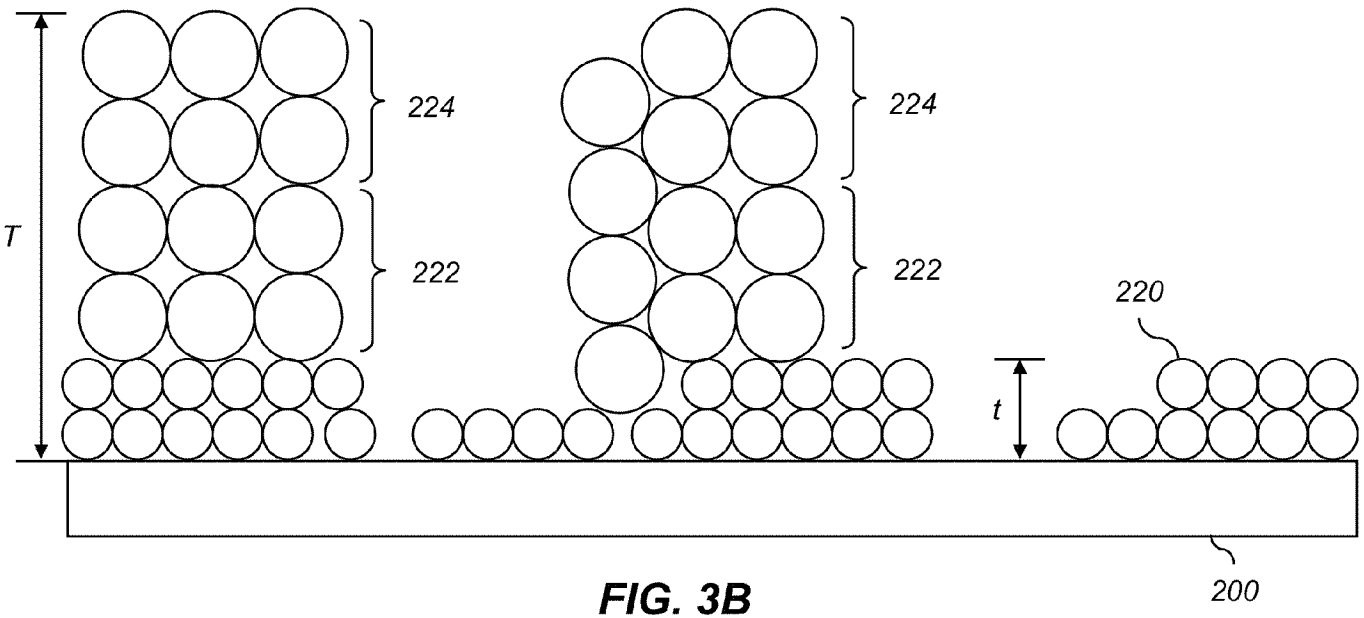
FIG. 3B illustrates the formation of tactile features by printing colorless print images over the top of the visible printed image of FIG. 3A.

In one mode of practicing this invention, the use of "clear" non-marking toner particles allows tactile features to be provided without affecting overall print density. FIG. 3A shows a receiver medium 200 having a print image 220 formed using electrographic printing modules 10A, 10B, 10C and 10D. As shown in FIG. 3A, the print image has a stack height "t". Where 8 μm marking particles are used, the stack height of the print image can be between 4 and 8 μm after the fusing process. FIG. 3B shows the receiver medium 200 where colorless print images 222 and 224 have been applied using electrographic printing modules 10E and 10F, providing a stack height "T" sufficient to form a tactile image feature. In this example, the development stations for electrographic printing modules 10E and 10F supply developer that includes carrier particles and non-pigmented non-marking toner particles (sometimes referred to as "clear toner" or "colorless toner"). Using non-marking particles can allow the stack height to be built up without significantly affecting the image density. The non-marking particles used in forming the tactile features can be larger in size than the colored marking particles used to form the print image 220 to provide a larger stack height "T". Additional details regarding the formation of the colorless print images 222 and 224 according to one embodiment are described in the aforementioned U.S. Patent Application Publication 2011/0200933.

The present invention will now be described with reference to FIG. 4. An input image 300 includes image content and is specified by image data generally in the form of pixel values for an array of image pixels. A print visible image step 305 is used to print the input image 300 onto a receiver medium using a printing apparatus, thereby forming a printed visible image 310 using one or more visible colorants. In some embodiments, the image content of the input image 300 includes photographic image content, such as a digital image captured of a scene using a digital camera. The input image 300 can also include other types of image content such as artwork image content (e.g., computer generated artwork, or a scan of a drawing or a painting), graphical image content (e.g., a pie chart or a company logo) and textual image content. In some cases, the input image 300 can be a composite image including multiple types of image content. FIG. 5 shows an exemplary printed visible image 310 including a photographic image of a person sitting on a log in front of a mountain lake.

In some embodiments, the printing apparatus used to print the printed visible image 310 uses an electrographic printer engine 100, such as that described with respect to FIGS. 1-2, to form the printed visible image 310. In this case, the visible colorants are colored toners. In other embodiments, the printing apparatus can use any type of printing technology known in the art. For example, the printing apparatus can be an inkjet printer that forms images by depositing drops of ink onto the receiver medium, a thermal dye transfer printer that forms images by transferring dyes from a donor material to the receiver medium, or a printing press that forms images by transferring ink from a printing plate to the receiver medium.

An analyze image step 315 is used to analyze the image data for the input image 300 to determine associated image information 320. In a preferred embodiment, the analyze image step 315 segments the input image 300 into a plurality of image regions 325, and the image information 320 specifies the type of image content in each of the image regions 325.

In some embodiments, the analyze image step 315 is performed using an automatic algorithm executing on a digital image processing system. The automatic algorithm can include an automatic image segmentation process for segmenting the input image 300 into the image regions 325, and a semantic analysis process that identifies the type of image content in each of the image regions. Processes for automatically segmenting an input image 300 into a plurality of image regions 325, and for determining the type of image content are well-known in the image understanding art.

In other embodiments, the analyze image step 315 is performed manually by a user. For example, a user interface can be provided enabling the user to define image regions 325, for example by drawing a series boundary lines that separate the image regions 325. Once the user has defined the image regions 325, a user interface can be provided enabling the user to associate a type of image content with each image region.

Figure 6:
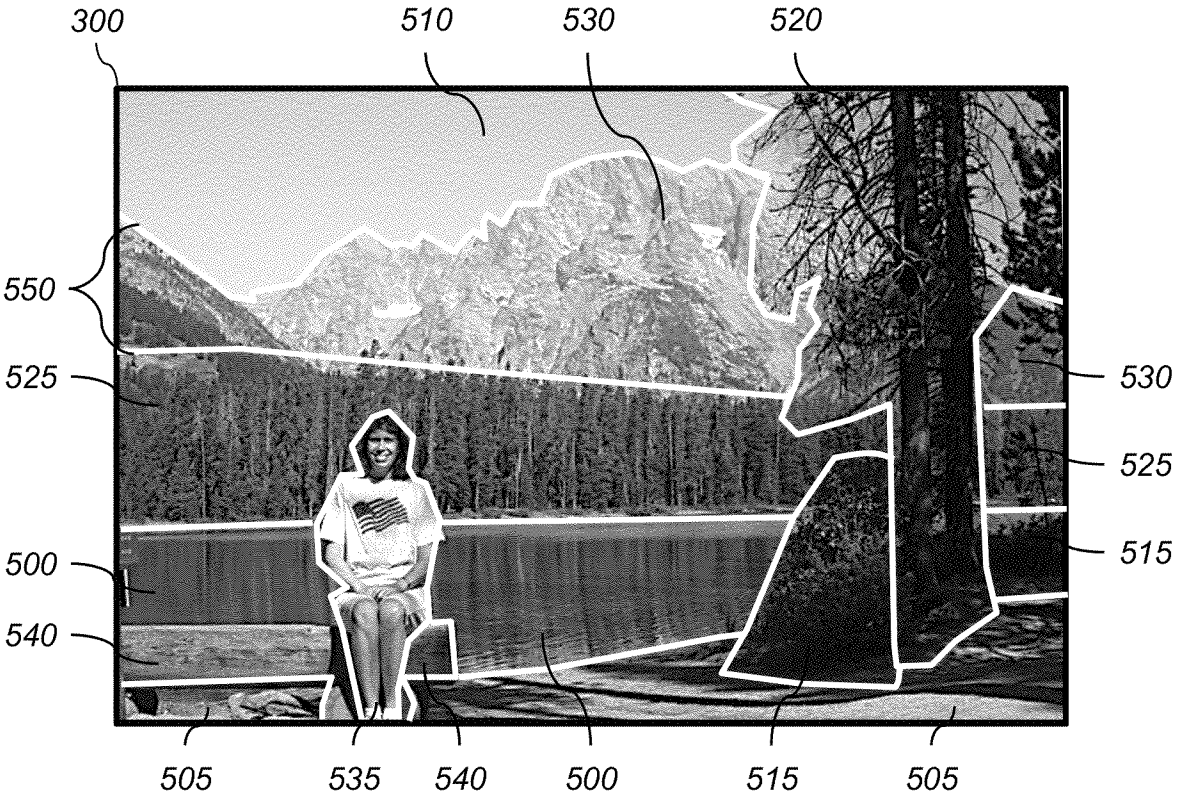
FIG. 6 shows a set of image regions identified for the printed image of FIG. 5.

FIG. 6 shows an input image 300 that has been segmented into a plurality of image regions 325 (FIG. 4) using a manual process where a series of boundary lines 550 between the image regions 325 are drawn using an appropriate user interface. Each of the defined image regions 325 have been manually designated using an appropriate user interface to be a water image region 500, a sand image region 505, a sky image region 510, a plant image region 515, a tree image region 520, a forest image region 525, a mountain image region 530, a person image region 535 or a log image region 540, according to the associated image content.

Figure 4:
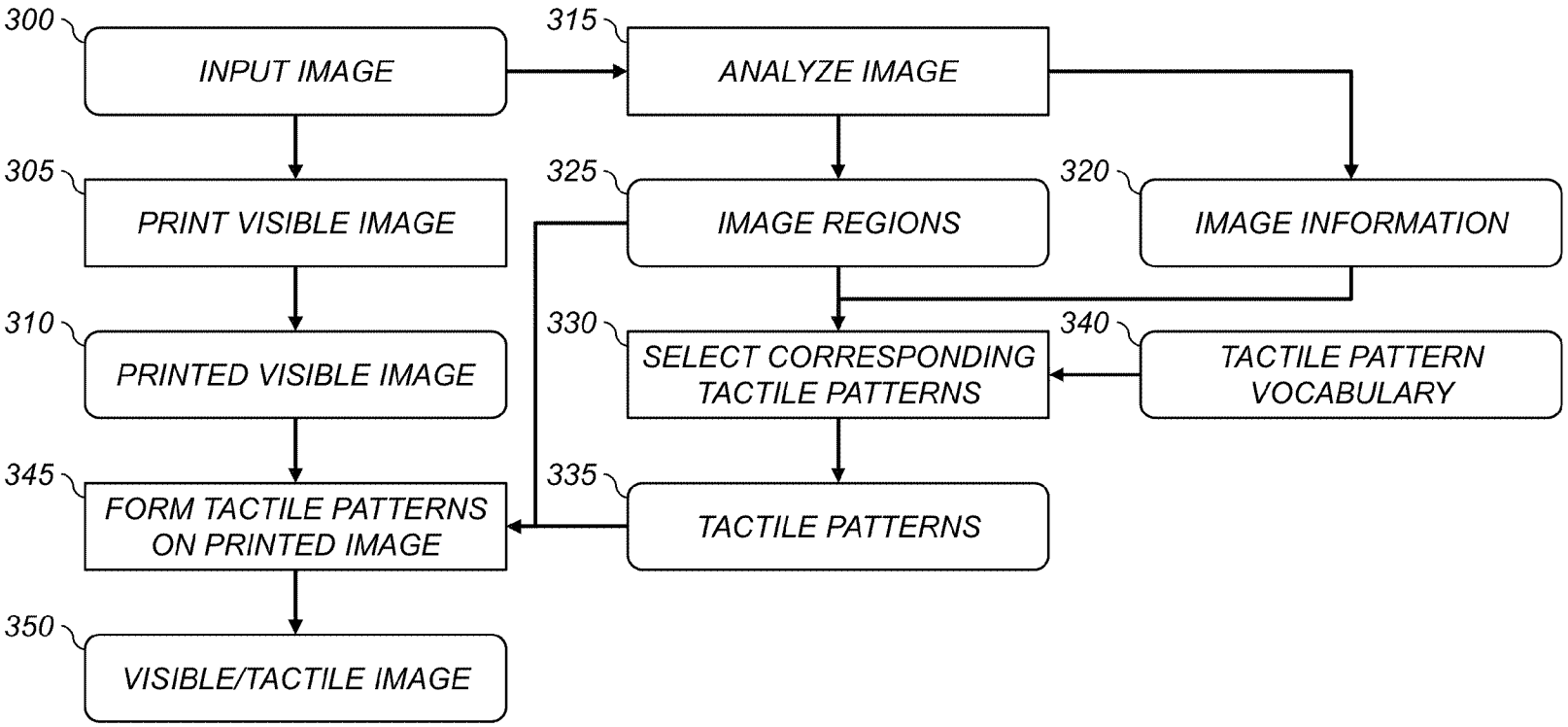
FIG. 4 is flow diagram showing the steps of the present invention according to a preferred embodiment.

Returning to a discussion of FIG. 4, a tactile pattern vocabulary 340 is defined, each tactile pattern having a defined meaning that relates to, and conveys information about, a particular type of image content. As will be described later, in some embodiments the tactile patterns in the defined tactile pattern vocabulary 340 are homogeneous texture patterns that can be used to fill image regions 325 corresponding to a particular type of image content. (For example, the homogeneous texture patterns can be represented by "texture tiles" that can be "tiled" in a repeating pattern to fill the image regions 325.) In some embodiments, the tactile patterns in the defined tactile pattern vocabulary include Braille characters that form words conveying information about the corresponding image content at a particular location in the printed visible image 310. One skilled in the art will recognize that the tactile pattern vocabulary 340 can also include other types of tactile patterns in various embodiments of the present invention.

A select corresponding tactile patterns step 330 is used to select tactile patterns 335 to be formed as a function of location on the printed visible image 310. In some embodiments, the select corresponding tactile patterns step 330 selects a tactile pattern 335 to be used for each of the image regions 325 determined by the analyze image step 315.

A form tactile patterns on printed image step 345 is then used to form a tactile image including the selected tactile patterns 335 onto the receiver medium of the printed visible image 310, thereby providing a visible/tactile image 350 in accordance with the present invention. It should be noted that it is not required that the tactile image information be formed onto the receiver medium after the printed visible image 310 has been printed. In some embodiments, the tactile image information can be formed onto the receiver medium before the printed visible image 310 has been printed, or can be formed concurrently with the printed visible image 310 being printed.

In accordance with the present invention, the visible/tactile image 350 includes visible image information that can be viewed by a sighted person, as well as tactile information that can be touched by a visually-impaired person to enable them to "view" the image as well. The tactile information provides the visually-impaired person with information pertaining to the printed visible image 310 viewed by the sighted person in a spatially-correlated arrangement.

The form tactile patterns on printed image step 345 can form the tactile patterns 335 using any method known in the art. In some cases, the tactile patterns can be provided using the printing device that was used to form the printed visible image 310. In other embodiments, the tactile patterns 335 can be formed using a separate texturing device (e.g., a mechanical embossing device).

In some embodiments, the printed visible image 310 is formed using an electrographic printing system, such as that described with respect to FIGS. 1-3. In such cases, the tactile patterns 330 can be formed on the printed visible image 310 using clear (or colored) toner. In some embodiments, the tactile patterns can be formed using one of the approaches described in the aforementioned commonly-assigned U.S. Patent Application Publication 2008/0159786 to Tombs et al., U.S. Pat. No. 8,064,788 to Zaretsky et al., U.S. Patent Application Publication 2011/0200360 to Tyagi et al., U.S. Patent Application Publication 2011/0200933 to Tyagi et al., and U.S. Patent Application Publication 2011/0200932 to Tyagi et al., each of which is incorporated herein by reference.

In other embodiments, the form tactile patterns on printed image step 345 can employ an expandable (i.e., "swellable") receiver medium that can be selectively activated to provide tactile features. One approach for fabricating a receiver medium of this type is described in the aforementioned commonly-assigned U.S. Pat. No. 5,125,996 to Campbell et al., entitled "Three dimensional imaging paper," which is incorporated herein by reference. This approach involves dispersing hollow expanding synthetic thermoplastic polymeric microspheres within the receiver medium (or coated on the receiver medium). Tactile features can then be formed by using a scanning laser beam (or some other thermal energy source) to selectively apply thermal energy, thereby causing the microspheres in discrete areas of the paper to expand and form a tactile feature.

In a variation of this approach, a printing process can be used to selectively apply an expandable material (e.g., a solution including hollow expanding synthetic thermoplastic polymeric microspheres) to the surface of the printed visible image 310 in accordance with the tactile patterns 335. The expandable material can then be activated (e.g., using heat) to form the tactile features.

Another approach that the form tactile patterns on printed image step 345 can use to form the tactile patterns 335 is to employ a mechanical embossing process. Such methods are well-known in the art for forming Braille characters, or other forms of tactile patterns that are used for a wide variety of applications (e.g., greeting cards). A wide variety of mechanical embossing techniques can be used. For example, some mechanical embossing techniques form tactile patterns by creating an embossing plate with surface relief that can be pressed against the receiver medium thereby deforming it to form the tactile features. In other embodiments, the receiver medium can be embossed by passing it under a series of mechanical pins that can be selectively activated to press against the receiver medium, thereby forming tactile patterns by creating depressions in the surface of the receiver medium.

In other embodiments, the form tactile patterns on printed image step 345 can form the tactile patterns 335 using a printing process, such as screen printing, that is capable of applying a thick layer of an ink, or some other type of substance, to provide the tactile features.

Preferably, the formation of the tactile patterns does not substantially change the color of the printed visible image 310 so that the appearance of the visible/tactile image 350 is not noticeably different from the appearance of the printed visible image 310 to a human observer. A good rule of thumb is that the colors are preferably not changed by more about 3 $\Delta E^*$ units, as measured using the well-known CIELAB color system. However, in some embodiments larger color differences can be accepted. If the color differences are significant, it may be desirable to use color management to adjust the color of the printed visible image 310 so that the visible/tactile image 350 has a desired average color value.

Figure 7:
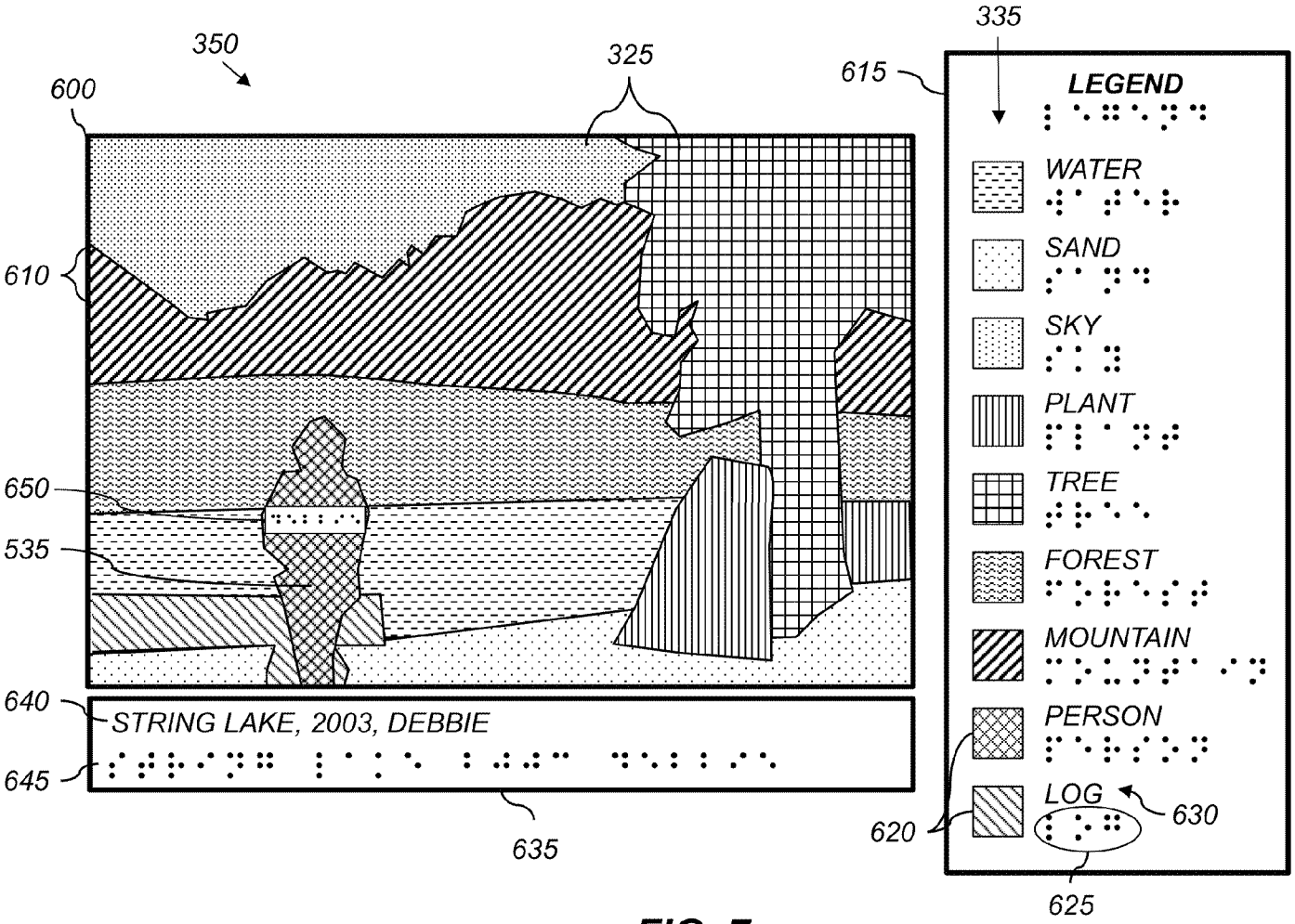
FIG. 7 shows an example of a tactile image according to an exemplary embodiment of the present invention.

FIG. 7 shows an example of a tactile image 600 corresponding to the printed visible image 310 of FIG. 5. The tactile image 600 includes a plurality of tactile patterns 335 that are used to fill a set of image regions 325 corresponding to those defined in FIG. 6. The black regions of the tactile patterns 335 correspond to those areas where the surface of the visible/tactile image 350 (FIG. 4) should be raised, while the white regions of the tactile patterns 335 correspond to those areas where the surface of the visible/tactile image 350 should be at a lower height. Each image region 325 is filled with the tactile pattern 335 corresponding to the image content at that location in the printed visible image 310 (FIG. 5). If a visually-impaired person runs his/her fingers over the surface of the visible/tactile image 350 (FIG. 4) formed using the printed visible image 310 of FIG. 5 and the tactile image 600 of FIG. 7, the tactile pattern 335 at a particular location can be detected and can convey information regarding the image content in the input image 300 (FIG. 4). In this way, the visually-impaired person is able to understand the spatial relationships between the different elements of the input image 300, much as a sighted person can do by looking at the printed visible image 310.

In some embodiments, the region boundaries 610 between the image regions 325 can be printed as raised tactile features in the tactile image 600 to provide the visually-impaired person with a clear delineation between the image regions 325.

In some embodiments, the tactile patterns 335 in the tactile pattern vocabulary 340 that are associated with the different types of image content can be fixed across a particular population of images. This enables the visually-impaired person to learn to interpret the meaning of the different tactile patterns 335, much like they can learn to interpret the meaning of Braille character patterns. The population of images using a particular tactile pattern vocabulary 340 can be as small as a pair of images printed on a particular page, or can be as large as all of the images in a particular image collection or all of the images used in a particular application. If the method of the present invention becomes widely used, it may become desirable to define a standard tactile pattern vocabulary 340 (FIG. 4) that is used for a wide range of applications.

In other embodiments, the tactile patterns 335 in the tactile pattern vocabulary 340 that are associated with the different types of image content can be defined on an image-by-image basis. In this case, it can be valuable to provide a legend 615 on the visible/tactile image 350 that defines the meaning of the tactile patterns 335 used for that particular image. The legend 615 can include sample tactile patterns 620, together with Braille labels 625 specifying the associated meaning (e.g., the associated type of image content). The legend 615 can optionally included text labels 630 that are viewable by a sighted person corresponding to the Braille labels 625. This can enable a sighted person who is unfamiliar with Braille to understand the meaning of the different tactile patterns 335. Defining a tactile pattern vocabulary 340 that is customized to the image content of a particular image has the advantage that it can be used to convey more specific information that is relevant to the particular image than it would be practical to address using a more limited standardized tactile pattern vocabulary 340. However, it has the disadvantage that the visually impaired person would need to learn the meanings for a new set of tactile patterns 335 for each image.

In some embodiments, the tactile patterns 335 in the tactile pattern vocabulary 340 are customized on an image-by-image basis according to the image content in the input image 300. This enables the meanings of the tactile patterns to be more specific to the image content of a particular input image than would be possible using a standard tactile pattern vocabulary 340. For example, different tactile patterns 335 can be defined for each person in a particular image, rather than using a more generic "person" tactile pattern. The legend 615 can then associate the names of the persons with the corresponding tactile patterns 335.

It can be desirable for the tactile patterns 335 to be representative of the visual image content in the different image regions 325. For example, a tactile pattern 335 can be determined for the water image region 500 (FIG. 6) that includes a series of "ripples" corresponding to the visible surface ripples on the water in the input image 300. Similarly, a tactile pattern 335 can be determined for the sand image region 505 (FIG. 6) that includes a fine grained texture corresponding to the visible texture of sand in the input image 300. The representative tactile patterns can be selected from a library of available tactile patterns, or can be determined using any method known in the art.

In some embodiments, the tactile patterns 335 in the tactile pattern vocabulary 340 can be determined by analyzing the image content in the input image 300 and determining tactile patterns 335 that are representative of visible patterns in the image content. For example, in one such embodiment, a representative portion of a particular image region 325 (i.e., an "image tile") is identified. Preferably, the identified representative portion should have a visually uniform texture. A luminance image is then determined containing only gray scale image information. A sharpening step is then applied to enhance the image detail in the luminance image. A tone scale adjustment (e.g., histogram equalization) is then applied to stretch the tone levels out to use the full range of available code values, and to increase the contrast to exaggerate the texture effects. In some embodiments, a thresholding step (e.g., a halftoning operation such as error diffusion) can be used to binarized the resulting tactile pattern 335.

A caption 635 can optionally be provided in association with the visible/tactile image 350. The caption 635 preferably includes both a visible text caption 640 viewable by a sighted person, as well as a Braille caption 645 that can be sensed by a visually-impaired person. The caption 635 can include various information pertaining to the visible/tactile image 350. Examples, of such information would include a date/time identifier (e.g., "2003"), a weather identifier (e.g., "sunny," a season identifier (e.g., "summer"), a geography identifier (e.g., "mountain lake," or "canyon," or "seashore"), a location identifier (e.g., "Wall St., NY City," or "Disney World," or "Grand Tetons National Park") or an identity of a person or object pictured in the visible/tactile image 350 (e.g., "Debbie"). The information presented in the caption 635 can provide additional insight to the visually-impaired person regarding the content of the visible/tactile image 350. While the caption 635 in FIG. 7 is shown positioned below the visible/tactile image 350, it will be obvious that the caption 635 can be positioned in a variety of locations, including being imbedded within the visible/tactile image 350.

In some embodiments, additional information can be included in the tactile image 600 to supplement the tactile patterns 335. For example, a Braille label 650 can be added that provides additional information pertaining to the image content of the input image 300. For example, the Braille label 650 shown in FIG. 7 provides the name of the person pictured in the person image region 535. Other examples of additional information that could be added to the tactile image 600 using Braille labels associated with particular image content would include an identifier of an object type (e.g., "lake," "man," "woman," or "car"), an object identity (e.g., "String Lake," or "Honda Civic"), an object color (e.g., "blue") a surface material identifier (e.g., "wood," "cloth," "leather," "metal," or "skin")

Figure 8:
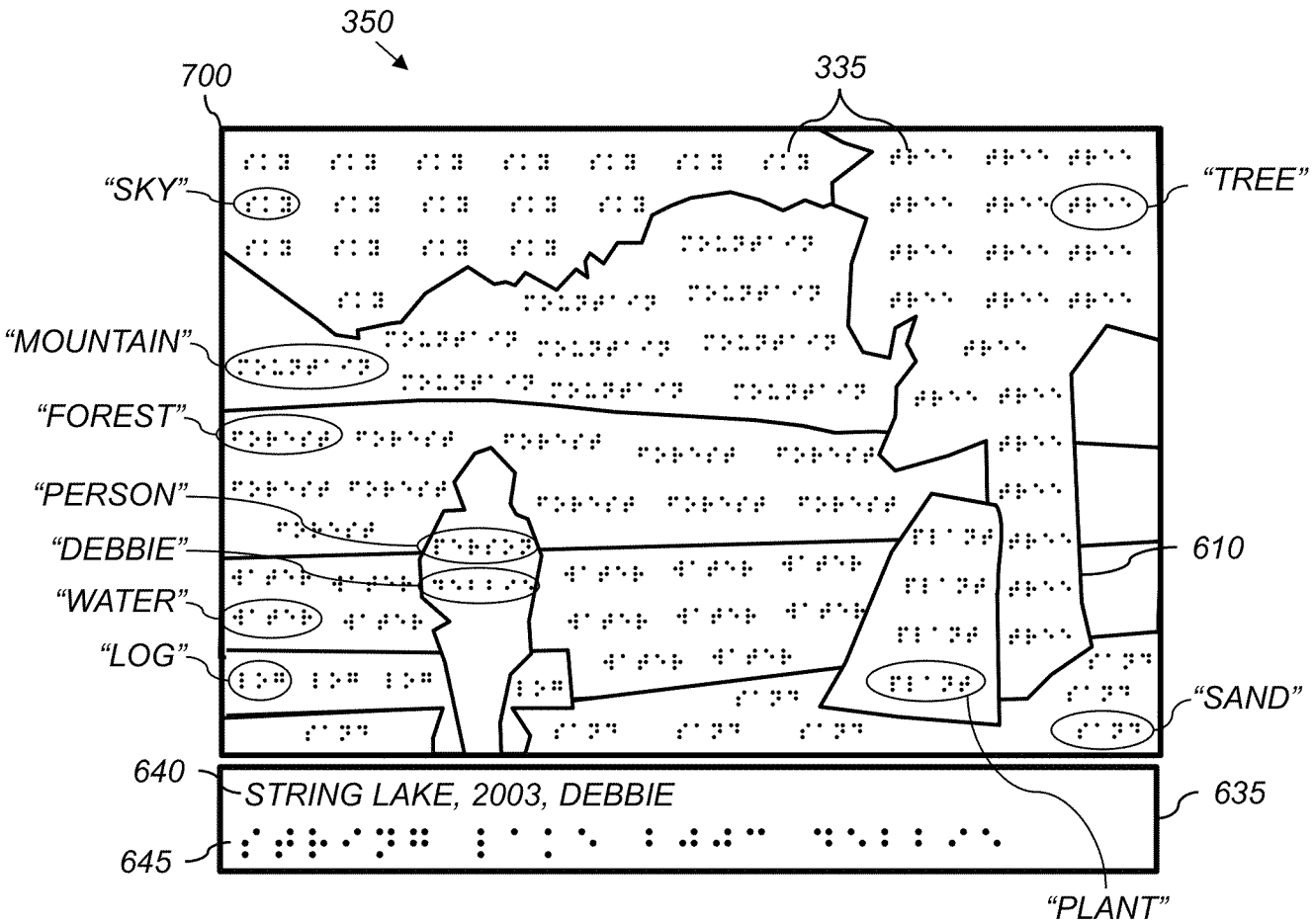
FIG. 8 shows an example of a tactile image according to an alternate embodiment of the present invention.

In other embodiments, rather than using homogeneous textures in each image region 325 as shown in FIG. 7, other types of tactile patterns 335 can alternately be used. For example, the tactile patterns 335 in the defined tactile pattern vocabulary 340 (FIG. 4) can include Braille characters that form words conveying information about the corresponding image content at a particular location. FIG. 8 shows an example of a tactile image 700 where the tactile patterns 335 selected for each image region 325 are Braille tactile patterns corresponding to words that convey information about the image content at the corresponding location in the visible/tactile image 350. For example, a tactile pattern including the Braille characters for the word "SKY" can be overlaid on the sky image region 510 (FIG. 6). The region boundaries 610 can be optionally be provided with raised tactile lines as was discussed earlier with regard to FIG. 7. The Braille tactile patterns then provide an indication of the image content within a particular image region. In the illustrated configuration, the Braille tactile patterns are provided in a repeating pattern to fill the corresponding image region. In other embodiments, each image region is labeled with a single Braille tactile pattern.

The invention has been described in detail with particular reference to certain preferred embodiments thereof, but it will be understood that variations and modifications can be effected within the spirit and scope of the invention.

PARTS LIST

10, 10A, 10B, 10C, 10D, 10E, 10F electrographic printing module
30 fusing assembly
31 heated fusing roller
32 pressure roller
100 electrographic printer engine
105 imaging cylinder
106 exposure subsystem
107 development station subsystem
108 primary charging subsystem
110 intermediate transfer member
115 first transfer nip
117 second transfer nip
118 transfer backup roller
121, 122 meter
123 logic and control unit
124 logic and control component
200 receiver medium
210 transport belt
220 print image
222, 224 colorless print image
300 input image
305 print visible image step
310 printed visible image
315 analyze image step
320 image information
325 image regions
330 select corresponding tactile patterns step
335 tactile patterns
340 tactile pattern vocabulary
345 form tactile patterns on printed image step
350 visible/tactile image
500 water image region
505 sand image region
510 sky image region
515 plant image region
520 tree image region
525 forest image region
530 mountain image region
535 person image region
540 log image region
550 boundary lines
600 tactile image
610 region boundary
615 legend
620 sample tactile patterns
625 Braille label
630 text label
635 caption
640 text caption
645 Braille caption
650 Braille label
700 tactile image

The invention claimed is:

1. A method for printing an image to convey information to both a sighted person and a visually-impaired person, comprising:

printing an image including image content on a receiver medium using one or more visible colorants, the printed image being viewable by the sighted person, wherein the image content includes photographic image content, artwork image content or graphical image content;

defining a vocabulary of different tactile patterns, each tactile pattern having a defined meaning; and providing tactile patterns on the surface of the printed image, the tactile pattern provided at a particular location being selected from the predefined vocabulary such that when a visually-impaired person touches the tactile pattern at the particular location, the tactile pattern conveys information about the corresponding image content at the particular location to the visually-impaired person;

wherein the image is segmented into segmented image regions corresponding to particular types of image content, each segmented image region being defined by an area surrounded by a region boundary, and wherein the tactile patterns in the defined vocabulary include predefined homogeneous texture patterns that are used to fill the areas within the region boundaries of the segmented image regions.

2. The method of claim 1 wherein the tactile patterns in the defined vocabulary include Braille characters that form words conveying information about the corresponding image content at the particular location.

3. The method of claim 1 wherein a standardized vocabulary of homogeneous texture patterns is defined for use with a population of images.

4. The method of claim 1 wherein the vocabulary of tactile patterns is customized according to the image content of a particular image.

5. The method of claim 4 wherein the homogeneous texture patterns in the defined vocabulary are defined by analyzing the image content in the particular image and determining tactile patterns that are representative of visible patterns in the image content.

6. The method of claim 1 further including printing a legend in association with the printed image that defines the meaning of the homogeneous texture patterns selected from the defined vocabulary.

7. The method of claim 6 wherein the meanings of the homogeneous texture patterns are represented in the legend at least using words formed with Braille characters that can be sensed by the visually-impaired person.

8. The method of claim 1 wherein the information about the corresponding image content includes an object type identifier, a material identifier, a color identifier, or an identity of a person or object.

9. The method of claim 1 further including providing a caption in association with the printed image, the caption including words formed using Braille characters that communicate information pertaining to the printed image to the visually-impaired person.

10. The method of claim 1 the caption includes a date/time identifier, a weather identifier, a season identifier, a geography identifier, a location identifier or an identity of a person or object.

11. The method of claim 1 wherein the image is printed on a printing device, the printing device being an electrographic printer, an inkjet printer, a thermal printer or a printing press.

12. The method of claim 11 wherein the tactile pattern is provided using the printing device.

13. The method of claim 11 wherein the tactile pattern is provided using a separate texturing device.

14. The method of claim 1 wherein the formation of the tactile patterns does not substantially change a perceived color of the printed image.

15. The method of claim 1 wherein the tactile patterns are provided, at least in part, by selectively printing a pattern of a clear substance on the receiver medium.

16. The method of claim 15 wherein the clear substance is an ink or an electrographic toner.

17. The method of claim 15 wherein the clear substance is printed over the top of the one or more visible colorants.

18. The method of claim 1 wherein the tactile patterns are provided, at least in part, by a mechanical embossing process.

19. The method of claim 1 wherein the tactile patterns are provided, at least in part, by selectively activating an expandable material provided within or coated on the receiver medium.

20. The method of claim 19 wherein the expandable material includes thermoplastic polymeric microspheres that expand when activated using a thermal energy source.

21. The method of claim 1 wherein the tactile patterns are provided, at least in part, by selectively applying an expandable material to the surface of the printed image in accordance with the tactile patterns, and then activating the expandable material to form the tactile patterns.

22. The method of claim 1 wherein boundaries between the segmented image regions are printed as raised tactile features.

23. The method of claim 1 wherein the segmented image regions are determined using an automatic image segmentation process.

24. The method of claim 1 wherein the segmented image regions are determined manually by a user.

* * * * *